US008825366B2

(12) United States Patent
Giovannini et al.

(10) Patent No.: US 8,825,366 B2
(45) Date of Patent: Sep. 2, 2014

(54) METHOD AND DEVICE FOR DETERMINING AN OPTIMAL FLIGHT TRAJECTORY FOLLOWED BY AN AIRCRAFT

(75) Inventors: Andrea Giovannini, Toulouse (FR); Thomas Pastre, Caluire et Cuire (FR)

(73) Assignee: Airbus Operations (S.A.S.), Toulouse Cedex (FR)

( * ) Notice: Subject to any disclaimer, the term of this patent is extended or adjusted under 35 U.S.C. 154(b) by 125 days.

(21) Appl. No.: 13/309,150

(22) Filed: Dec. 1, 2011

(65) Prior Publication Data

US 2012/0143505 A1 Jun. 7, 2012

(30) Foreign Application Priority Data

Dec. 7, 2010 (FR) ..... 10 60191

(51) Int. Cl.
*G08G 5/00* (2006.01)

(52) U.S. Cl.
CPC ..... *G08G 5/0039* (2013.01); *G08G 5/0091* (2013.01); *G08G 5/006* (2013.01); *G08G 5/0052* (2013.01); *G08G 5/0082* (2013.01)
USPC ..... 701/301; 701/3; 701/411; 701/415

(58) Field of Classification Search
CPC ... G08G 5/0039; G08G 5/006; G08G 5/0091; G08G 5/0052
USPC ..... 701/301, 410, 528, 532, 533, 540, 3, 701/300, 411, 415, 416, 466
See application file for complete search history.

(56) References Cited

U.S. PATENT DOCUMENTS

| | | | | |
|---|---|---|---|---|
| 6,173,219 | B1 * | 1/2001 | Deker | 701/3 |
| 6,317,690 | B1 * | 11/2001 | Gia | 701/301 |
| 6,349,258 | B1 * | 2/2002 | Bonhoure et al. | 701/528 |
| 6,401,038 | B2 * | 6/2002 | Gia | 701/301 |
| 6,424,889 | B1 * | 7/2002 | Bonhoure et al. | 701/3 |
| 6,529,821 | B2 * | 3/2003 | Tomasi et al. | 701/467 |
| 7,194,353 | B1 * | 3/2007 | Baldwin et al. | 701/528 |
| 8,275,499 | B2 * | 9/2012 | Coulmeau et al. | 701/14 |
| 8,386,110 | B2 * | 2/2013 | Maekawa et al. | 701/23 |
| 2010/0100308 | A1 * | 4/2010 | Coulmeau et al. | 701/122 |

FOREIGN PATENT DOCUMENTS

| | | |
|---|---|---|
| FR | 2607948 | 6/1988 |
| GB | 2440249 | 1/2008 |

OTHER PUBLICATIONS

French Patent Office, French Search Report FR 1060191, Sep. 2, 2011 (2 pgs).

* cited by examiner

*Primary Examiner* — John Q Nguyen
*Assistant Examiner* — Michael Whalen
(74) *Attorney, Agent, or Firm* — Wood, Herron & Evans, LLP

(57) ABSTRACT

The device includes processor elements for determining an optimal flight trajectory, which is free of collision with obstacles, which respects constraints of energy, and which links the current position of the aircraft to a target point defined by an operator. The device minimizes additional crew work required to update and validate a new trajectory when an original flight plan needs to be modified to avoid moving obstacles such as storms or other aircraft.

13 Claims, 2 Drawing Sheets

METHOD AND DEVICE FOR DETERMINING AN OPTIMAL FLIGHT TRAJECTORY FOLLOWED BY AN AIRCRAFT

TECHNICAL FIELD

The present invention relates to a method and a device for determining an optimum flight trajectory to be followed by an aircraft, in particular a transport airplane.

More particularly, the present invention aims at generating, using on-board devices, real time optimized trajectories, to be flown in constrained dynamic environments, that is in environments that are able to contain objects (or obstacles), with which the aircraft should prevent from colliding, and including mobile objects such as meteorological disturbance areas, for instance, stormy areas, or other aircrafts.

BACKGROUND

It is known that managing the flight trajectory of an aircraft is generally to be carried out by an on-board system for managing the flight. Modifying a flight plan, more specifically, is often a tricky method, requiring multiple interactions with systems of the aircraft, the final result of which is not completely optimized. This is more specifically caused by difficulties and limitations inherent to the use of published lanes and procedures and by limitations of already existing functions for generating unpublished trajectories (for example <<DIR TO>>).

Currently, there are no on-board devices enabling to generate, in real time, in a simple way, optimum trajectories being independent from existing lanes and being free from obstacles, including of the dynamic type.

SUMMARY OF THE INVENTION

The present invention aims at solving these drawbacks. It relates to a method for determining an optimum flight trajectory for an aircraft, in particular a transport airplane, being defined in an environment able to contain mobile obstacles, the flight trajectory comprising a lateral trajectory and a vertical trajectory and being defined between a current point and a target point.

According to the invention, the method is remarkable in that, automatically, by using at least one obstacle data base relative to obstacles and a reference vertical profile, as well as a set objective received from an operator at a user input device that indicates a target point:

- determining with a first processor element at least one first section of a virtual flight trajectory from a current point, carrying out the following successive operations:
  - generating with a segment generation device at least one straight line segment with a predetermined length, starting at the current point;
  - conducting with a segment validation device a trial for validating each generated straight line segment, wherein the trial uses the at least one obstacle database and the reference vertical profile;
  - evaluating with a segment score calculator each validated straight line segment to assign a score being representative of an ability of the straight line segment to meet the set objective; and
  - recording with a first recording device each straight line segment, with the assigned score, into a storage memory as a first section of a corresponding at least one virtual trajectory extending from the current point to a downstream end;

- implementing with a second processor element an iterative processing, comprising the following successive operations, to determine subsequent sections of the at least one virtual trajectory:
  - determining with a virtual trajectory score comparison device, amongst the recorded virtual trajectories, a chosen virtual trajectory having a best score with respect to the set objective;
  - determining with a heading change determination device possible heading changes from the downstream end of the chosen virtual trajectory;
  - generating with a subsequent segment generation and validation device, for each one of the possible heading changes, a subsequent section of trajectory starting at the downstream end of the chosen virtual trajectory and comprising at least one of the following elements: one circle arc and one straight line segment, and then conducting a trial for validating the subsequent section of trajectory;
  - forming with a virtual trajectory updating device, for each generated and validated subsequent section of trajectory, at least one updated virtual trajectory made up of the chosen virtual trajectory followed by the subsequent section of trajectory, each of the at least one updated virtual trajectory extending from the current point to a downstream end;
  - evaluating with a virtual trajectory score calculator each of the at least one updated virtual trajectory to assign the at least one updated virtual trajectory a score being representative of an ability to reach the set objective; and
  - recording with a second recording device each of the at least one updated virtual trajectory with the score assigned into the storage memory; and
  - repeating with the second processor element the previous steps a) to f) until the downstream end of the at least one updated virtual trajectory having the best score corresponds to the target point, at which point the second processor element assigns the at least one updated virtual trajectory having the best score as an optimum flight trajectory; and
- transmitting with at least one transmission device the optimum flight trajectory to user devices and/or external devices.

The operations described in A/and B/can generally be implemented in both ways, that is from the aircraft to the target point and vice-versa.

Thus, thanks to the present invention, a 4D flight trajectory is generated in real time, having the following characteristics, as further detailed hereinafter:

- it is optimized;
- it is free from any collision with surrounding obstacles, including mobile obstacles;
- it meets energy constraints; and
- it represents a flight trajectory for linking the current position (or current point) of the aircraft to a target point defined by an operator, generally the pilot of the aircraft. This target point could, for instance, correspond to the threshold of the selected runway or to a stationary point on a usual STAR or APPR procedure for approach uses or even a meeting point of an initial flight plan.

The method according to the present invention is different from a usual processing carried out by a system for managing a flight, by its ability to provide an optimum trajectory independent from existing lanes, and by the simplicity of the actions leading to the generation of the trajectory, as detailed below. Moreover, the method ensures that the obtained trajectory is free from including dynamic obstacles (such as a stormy area or an aircraft), a performance that could not be provided by a flight managing system.

Moreover, the present invention is able to manage flight operational constraints in a minimum time, and it further provides optimized flying trajectories, on the basis of a processing of information generated by the flight managing system. The processing of such information allows complex constraints to be integrated, without managing the mathematical complexity in algorithms.

Thus, the method according to this invention provides, more specifically, the following advantages:

- it allows to support the crew in taking a decision on board. The method for generating a trajectory aims at reducing the workload of the crew in situations considered as complex on board. Such situations are associated with a high workload of the pilot, due including to a change of environment (change of runway in the approach phase for instance). The method for generating a trajectory is then involved implementing the thinking load associated with the decision taken regarding the trajectory, the pilot acting as the operator of the function and for validating the result. The method generates an optimum trajectory, free of any obstacle and meeting operational constraints, being supplied to user means. This optimum trajectory could, more particularly, be displayed on an on-board screen or be transmitted to an air traffic controller. It could also be used as a reference for the autopilot;
- it enables to validate a trajectory. The method for generating a trajectory simultaneously takes into consideration a plurality of constraints (ground, energy, flight physics, . . . ). The pilots could make use of said generating method for validating a trajectory they wish to follow (but they are unable to check the validity thereof as a result of too a complex environment); and
- it allows to generate a trajectory integrating pilots into the generation loop. The main use relies on the method without requiring particular parameters: the method generates an optimum trajectory on the basis of default parameters, being associated with the aircraft and the environment thereof. The crew can, however, orient and impose particular constraints for refining the trajectory or better meet a specific need, for instance generating a trajectory with a wider coverage area than that imposed by the navigation accuracy so as to increase the passage margins with respect to obstacles. Such an implementation can be used when by-passing a moving stormy area for instance, for overcoming variations of the environment.

Furthermore, advantageously, the altitude of the straight line segment is determined through said reference vertical profile.

Moreover, advantageously, for carrying out a validating trial for a section of trajectory:

- a protective shell is determined around said section of trajectory, preferably a protective shell relative to required navigation performance of the RNP type (<<Required Navigation Performance>>);
- such a protective shell is compared to obstacles from said data base(s) relative to obstacles; and
- said section of trajectory is considered to be valid if no obstacle is located in said protective shell.

Moreover, advantageously, for carrying out a trial for validating a section of trajectory with respect to mobile obstacles, the protective shell is compared to extrapolated positions of these mobile obstacles.

Furthermore, advantageously, for evaluating a section of trajectory:

- the distance remaining to be followed from the downstream end of said section of trajectory, for reaching the target point is determined;
- the difference of heading is determined between the heading at said downstream end and a target heading at said target point; and
- a score is attributed to said section of trajectory, as a function of said distance and of said difference of heading. This score illustrates the ability of the section of trajectory to meet the set objective, that is to allow the aircraft if it follows this section of trajectory to rapidly reach said target point while having then a heading close to the target heading.

Moreover, advantageously, when determining the possible changes of heading from the downstream end of the virtual trajectory, all the successive headings are taken into consideration, according to a predetermined pitch, from the current heading at the downstream end, for instance 10°, up to a maximum heading (for instance 170° from the current heading), and this on either side of said current heading.

Furthermore, advantageously:

- for generating a section of trajectory during the iterative processing:
  - first a circle arc is generated as a function of the speed at said downstream end, and a trial is carried out for validating this circle arc; then
  - a straight line segment is generated, associated with this circle arc, and a trial for validating the section of trajectory is carried out, comprising the circle arc and the straight line segment;
  - wherein the circle arc is determined so as to have the smallest radius able to be followed by the aircraft flying at a predictive speed; and/or
  - wherein the straight line segment is determined similarly to the straight line segment generated in previous steps.

The present invention also relates to a device for determining an optimum flight trajectory for an aircraft, in particular a transport airplane, being defined in an environment able to contain mobile obstacles, said flight trajectory comprising a lateral trajectory and a vertical trajectory and being defined between a current point and a target point.

According to this invention, the device is remarkable in that it comprises:

- a first set of information sources including at least one obstacle database relative to obstacles;
- a second set of information sources including a user input device allowing an operator to enter a set objective indicating at least a target point;
- a first processor element that determines at least one first section of a virtual trajectory from a current point, the first processor element comprising:
  - a segment generation device that generates at least one straight line segment with a predetermined length starting at the current point;
  - a segment validation device that conducts a trial for validating each generated straight line segment, wherein the trial uses the at least one obstacle database and a reference vertical profile;
  - a segment score calculator that evaluates each generated and validated straight line segment, and assigns each straight line segment a score being representative of an ability to reach the set objective;
  - a first recording device that records, in a storage memory, each straight line segment as the first section of a corresponding at least one virtual trajectory, with the assigned score, each of the at least one virtual trajectory extending from the current point to a downstream end;

a second processor element that implements an iterative processing to determine subsequent sections of the at least one virtual trajectory, the second processor element comprising:

a virtual trajectory score comparison device that determines, amongst all the virtual trajectories recorded in the storage memory, a chosen virtual trajectory having a best score with respect to the set objective;

a heading change determination device that determines possible heading changes from the downstream end of the chosen virtual trajectory;

a subsequent segment generation and validation device that generates, for each one of the possible heading changes, a subsequent section of trajectory starting at the downstream end of the chosen virtual trajectory and comprising at least one of the following elements: a circle arc and a straight line segment, and the subsequent segment generation and validation device then conducts a validation trial on the subsequent section;

a virtual trajectory updating device that forms, for each generated and validated subsequent section of trajectory, at least one updated virtual trajectory made up of the chosen virtual trajectory followed with the subsequent section of trajectory, each of the at least one updated virtual trajectory extending from the current point to a downstream end;

a virtual trajectory score calculator that evaluates each of the at least one updated virtual trajectory, and assigns the at least one updated virtual trajectory a score being representative of an ability to reach the set objective;

a second recording device that records, in the storage memory, each of the at least one updated virtual trajectory with the assigned score; wherein the second processor element repeats the iterative processing to determine subsequent sections of the at least one virtual trajectory until the downstream end of the at least one updated virtual trajectory having the best score corresponds to the target point, at which point the second processor element assigns the at least one updated virtual trajectory having the best score as an optimum flight trajectory; and at least one transmission device that transmits the optimum flight trajectory to user devices and/or external devices.

Consequently the device according to this invention allows to quickly provide a flight trajectory, taking into consideration all the operational needs associated with implementing aircrafts, without relying on a discretization of space references.

Additionally, advantageously:

said user means comprise a viewing screen of the aircraft, for displaying said optimum flight trajectory; and/or said fourth means comprise means for transmitting said optimum flight trajectory to means external to said device, in particular to on-board systems such as an autopilot system for instance or to means located outside the aircraft, including for informing the air traffic control.

Furthermore, advantageously, the device according to this invention both comprises:

one ground data base representing stationary constraints;

one weather data base. Such information could be issued from the on-board weather monitoring or be received via a usual data transmission link; and one data base relative to surrounding aircrafts, containing flight plans and predictions form aircrafts being identified in a given area.

In addition to information issued from said data bases, the device according to this invention relies, amongst others, on the following information:

one set of parameters configured by the pilot or set to default values. The only information being necessary for implementing the method is the target point (that is the point where the pilot wishes that the generated trajectory ends). This target point is defined by a geometric position (latitude, longitude, altitude, heading), but also potentially by auxiliary constraints (speed, configuration, . . . ). The most current target point in an approach phase is the threshold of the runway or a meeting point during a standard arrival procedure; and one vertical profile generated by the flight managing system for providing a descent reference for the aircraft. The vertical profile associates with each distance compared to the target point one altitude and one speed.

The present invention further relates to an aircraft, in particular a transport airplane, comprising a device such as mentioned hereinabove.

BRIEF DESCRIPTION OF THE DRAWINGS

The FIGS. of the appended drawing will better explain how this invention can be implemented. In these FIGS., like reference numerals relate to like components.

DETAILED DESCRIPTION

Figure 1:
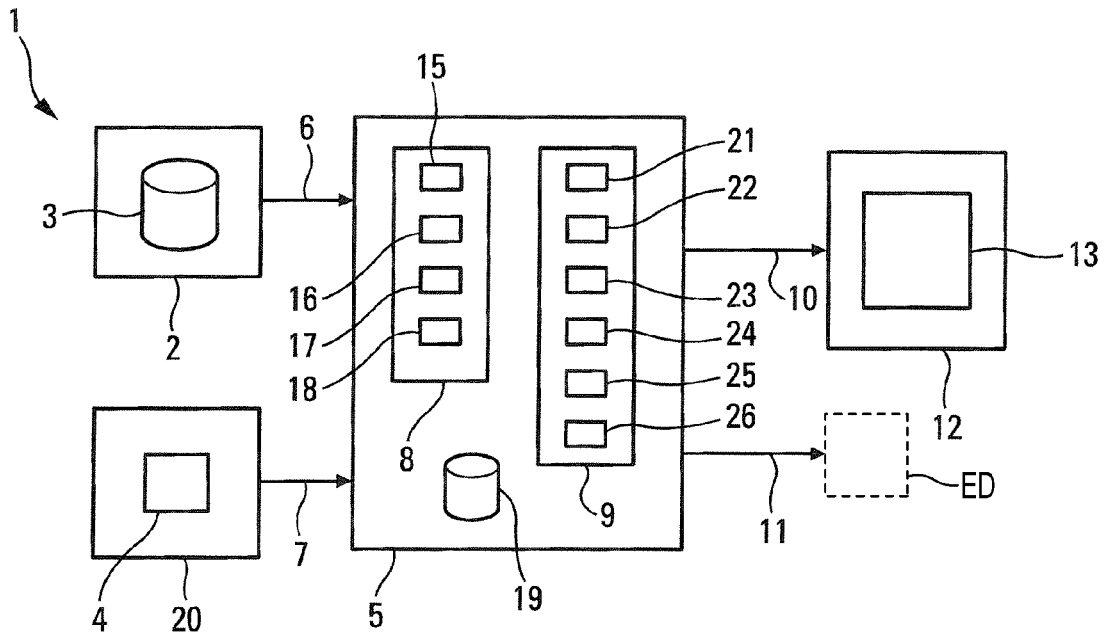
FIG. 1 is a block diagram of a device according to the invention.

The device 1 according to this invention and schematically shown on FIG. 1, aims at determining a flight trajectory TV to be followed by an aircraft (not shown), in particular a transport airplane, in an environment able to contain obstacles (including mobile obstacles). The flight trajectory TV comprises a lateral (or horizontal) trajectory being defined in a horizontal plane and a vertical trajectory being defined in a vertical plane. It is formed so as to link a current point P0 (corresponding to the current position of the aircraft) to a target point Pc.

According to this invention, the device comprises:

first set of informative sources 2 including at least one obstacle database 3 relative to obstacles;

second set of information sources 20, comprising, amongst others, a user input device 4 allowing an operator to enter in the device 1 an objective indicating at least the target point Pc;

one processing unit 5 being connected via links 6 and 7 respectively to the first set of information sources 2 and the second set of information sources 20 and comprising a first processor element 8 for determining a first section of flight trajectory T0 from the current point P0, as well as a second processor element 9 for implementing an iterative loop so as to form (via the first section T0) the optimum flight trajectory TV; and first transmission device 10 and second transmission device 11 for transmitting this optimum flight trajectory TV to user devices 12 and/or to external devices ED.

Moreover, according to this invention, the first processor element 8 comprises:

one segment generation device 15 for generating at least one straight line segment with a predetermined length starting at the current point P0;

one segment validation device 16 for carrying out a trial for validating each thus generated straight line segment, a validating trial using the obstacle database 3 relative to obstacles as well as a reference vertical profile;

one segment score calculator 17 for evaluating each generated and validated straight line segment giving it a score being representative of its ability to meet the objective set by the operator, more specifically a pilot of the aircraft; and one first recording device 18 for recording, in a usual storage memory 19, as a section of flight trajectory T0 illustrating a virtual trajectory, each thus obtained straight line segment, with the score being given to it.

Moreover, according to this invention, the second processor element 9 comprises:

one virtual trajectory score comparison device 21 for taking into consideration, amongst all the virtual trajectories recorded in the storage memory 19, the virtual trajectory having the best score with respect to the set objective;

one heading change determination device 22 for determining possible heading changes from the downstream end of this virtual trajectory;

one subsequent segment generation and validation device 23 for generating, for each one of the possible heading changes, a section of trajectory starting at the downstream end and comprising at least one of the following elements: a circle arc RF and a straight line segment TF, for which a validation trial is carried out;

one virtual trajectory updating device 24 for forming, for each generated and validated section of trajectory, a new section of flight trajectory made up of the virtual trajectory followed with the section of trajectory;

one virtual trajectory score calculator 25 for evaluating each thus formed section of trajectory, giving it a score being representative of its ability to meet the objective set by the operator; and one second recording device 26 for recording, in the storage memory 19, each new section of flight trajectory illustrating a virtual trajectory, with the score being attributed to it.

Moreover, the second processor element 9 repeats the string of previous iterations (of actions by the virtual trajectory score comparison device 21 to the second recording device 26) until the downstream end of the virtual trajectory having the best score at the end of an iteration corresponds to the target point Pc, this virtual trajectory then representing the optimum flight trajectory TV.

The device 1 according to this invention thus allows to generate an optimum trajectory TV respecting parameters of configuration of the pilot and of energy constraints. The trajectory is built up from a structure RNP (succession of <<Track to Fix>> and <<Radius to Fix>> segments such as defined in ARINC424, and referred to as TF and RF in the present description). Generating a trajectory does not integrate any guiding or energy management laws directly in the processing: the respect of such constraints occurs through integrating the vertical profile in input (produced by the flight managing system) and integrating transition rules of the flight managing system. This approach allows the device 1 to generate flying trajectories without overloading the functions with hard to process data.

The device 1 follows iterative logics, analyzing from a given point, the potential positions where the aircraft could fly respecting the constraints imposed by the pilot (via the user input device 4). The device 1 analyzes the different potential positions (referred to as virtual), giving it a score thanks to an internal evaluation function and sorts them in a list gathering all of the virtual positions. On the following iteration, the device 1 recovers the best known virtual position (best score in the list) and reiterates the loop (analysis of the potential adjacent positions, validation of produced segments of trajectory, recording of the new virtual position and insertion in the list). The research loop stops when the device 1 considers having found the best solution.

Subsequent criteria could, if necessary, be integrated into the calculation of the score, for instance the value of the wind component along the section of trajectory (if known or estimated).

The function implemented by the device 1 is based on a discrete representation of the research environment.

Preferably, the first set of information sources 2 including at least one obstacle database 3 of the device 1 simultaneously comprises:

one ground data base representing stationary constraints;

one weather data base. Such information could be issued from the on-board weather monitoring or be received via a usual data transmission link; and one data base relative to surrounding aircrafts, containing flight plans and predictions from aircrafts identified in a given area.

The device 1 thus refers to types of data bases, to be separately processed:

one stationary data base, representing obstacles, the position of which is not altered during the flight. This base contains discretizations of obstacles. The representation is a ground polygonal projection associated with a threshold height; and dynamic bases representing all the moving obstacles that the operator wishes to take into consideration in his evaluation. The dynamic bases integrate additional information regarding the progress of the areas. For stormy areas, the information is produced through analyzing the recent progress of areas (analysis of the weather monitoring or of data transmitted via a data transmission link for instance). The weather data base represents a discrete risk area associated with a cloudy area detected through monitoring. With each determining point of the risk area there is associated a shift vector calculated on the progress of the point during the last minutes of observation.

In addition to information issued from the obstacle database 3, the device 1 according to this invention relies, amongst others, on the following information:

one set of parameters configured by the pilot (using the user input device 4) or on the basis of default values. The only information necessary for implementing this invention is the target point Pc (that is the point where the pilot wishes that the generated trajectory ends). This target point Pc is defined by a geometric position (latitude, longitude, altitude, heading), but also potentially by auxiliary constraints (speed, configuration, . . . ). The most current target point Pc in an approach phase is the threshold of the runway or a meeting point during a standard arrival procedure; and one vertical profile generated by the flight managing system, providing a descent reference for the aircraft. The vertical profile (received for instance by the link 7) associates, with each distance compared to the target point Pc, an altitude and a speed.

Additionally:

user devices 12 comprise a viewing screen 13, on which the optimum flight trajectory TV can be displayed; and the second transmission device 11 can transmit the optimum flight trajectory TV to external devices ED that are external to the device 1, in particular to on-board systems such as an autopilot system for instance, or even to devices located outside the aircraft, including for informing the air traffic control (for instance via a usual data transmission link).

Figure 2:
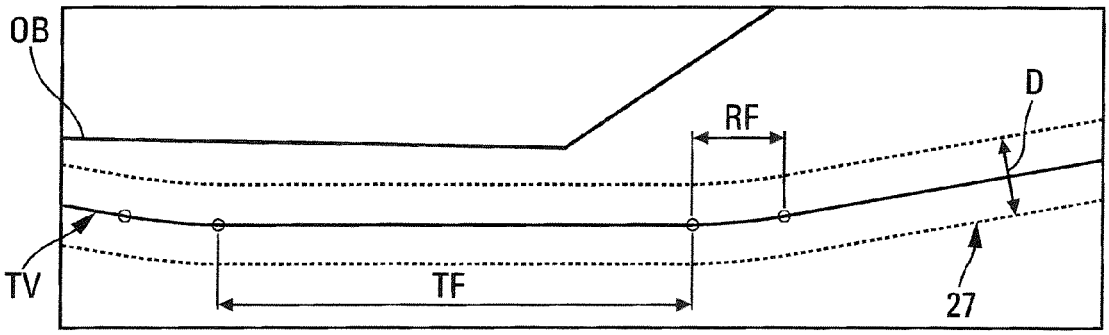
FIGS. 2 to 4 are diagrams for explaining the generation according to this invention of an optimum flight trajectory.

The first section of trajectory TV generated by the processing unit 5 comprises only one segment TF. The segment generation device 15 draws the ground projection of the segment TF as a function of interception parameters. The determination points do not inform about either the speed, or the altitude on the segment generated at this stage of determining. The analysis of the vertical profile by a sub-function allows to deduct the altitude associated with each point of determining of the segment TF. This is similar for predicting the speed. Once the virtual segment being plotted in 3D, the segment generation device 15 generates around the trajectory TV a protective shell 27 relative to required navigation performance of the RNP type (>>Required Navigation Performance<<), as shown on FIG. 2.

The protective shell 27 is defined around the trajectory TV, both on the horizontal plane (FIG. 2: width D) as well as on the vertical plane.

The segment validation device 16 then trials a 3D collision between this protective shell 27 and the stationary obstacles OB being known and stored in a data base. Detecting a collision 4D with dynamic areas occurs through linearly extrapolating positions, on the basis of the vectors being stored in the corresponding data base. The segment validation device 16 considers that the section of trajectory TF is validated if no obstacle OB is present in said protective shell 27.

In the case where a section of trajectory is validated, the segment score calculator 17 carries out the evaluation of the new virtual position associated with the validated segment TF. This is a function analyzing the interest of a virtual position with respect to the objective set by the pilot. In the case of an optimization in the distance being covered, the function evaluates the distance covered for reaching the evaluated virtual position and estimates the distance still to be covered for reaching the target point Pc. Such an assessment is based on a measurement of the distance between the virtual point and the target point Pc. Preferably, the evaluation of a section of trajectory does not only relate to the distance, but also to the convergence of headings between the current heading and the target heading Cc (at the target point Pc), this factor weighting the overall evaluation. The addition of these two values gives an overall score without unity representing the interest of the considered position, as explained below.

Afterwards, the first recording device 18 records in the storage memory 19 this section of flight trajectory illustrating a virtual trajectory, with the score that has been given to it by the segment score calculator 17.

Once this first section of flight trajectory has been created, the second processor element 9 implements the iterative processing loop. This loop is active as long as the second processor element 9 has not generated any trajectory considered as optimum by the evaluation function.

The second processor element 9 therefore follows iterative processing logics. At each passage of the loop, they search for (with the help of the virtual trajectory score comparison device 21) the best position that has been generated until then and analyze the possibilities of propagation from this position. The possibilities of propagation represent all the future positions where the aircraft could be located at an iteration n+1 from its current position at an iteration n.

To this end, the virtual trajectory score comparison device 21 thus scans the storage memory 19 for recovering therein the best score. This score is associated with an incomplete trajectory and a current virtual position. This virtual position will be used as a reference throughout the whole iteration of the loop, as the starting point of the propagation.

Afterwards, the heading change determination device 22 analyzes the possible heading changes (as a function of parameters of configuration of the pilot) at the point recovered by the virtual trajectory score comparison device 21, preferably in the shape of a discretization of the potential heading changes. As an example, a 10° discretization could be used for the heading change. The operator could also define, using the second set of information sources 20, the minimum and maximum heading changes he wishes to implement on a trajectory. Thus, the analysis of the possible heading changes comprises observing the shifting possibilities taking into consideration such parameters. As an example, for a configuration of 10° discretization and a 170° maximum heading change, the heading change determination device 22 identifies 35 different cases (−170°, −160°, . . . , −10°, 0, +10°, +20°, . . . , +160°, +170°), as shown on FIG. 3.

Consequently, for determining the possible heading changes from the downstream end of the virtual trajectory (having the best score), the heading change determination device 22 takes into consideration, from the current heading at the downstream end, all the successive headings, according to a predetermined pitch, for instance 10°, and this up to a maximum heading (for instance 170° of the current heading). This consideration is achieved on either side of the current heading.

With each potential heading change, a new change of direction of the trajectory is associated. The following steps are implemented for each one of the acceptable heading changes.

For each of such heading changes, the subsequent segment generation and validation device 23 comprises a device for carrying out the following successive operations, as further detailed hereinafter:

generation of a segment RF as a function of the speed prediction at the current point:

generation of a 2D segment RF;

update of the speed and altitude information on the segment RF, based on the vertical profile;

generation of protective shells RNP on the segment RF;

4D collision trials; and validation of the segment RF; and generation of a segment TF associated with the validated segment RF:

generation of a 2D segment TF;

update of the speed and altitude information;

generation of protective shells RNP on the segment TF;

4D collision trials; and validation of the segment TF.

For forming a new section of trajectory, the subsequent segment generation and validation device 23:

thus first generates a circle arc RF as a function of the speed at the downstream end, and carries out a trial for validating this circle arc RF. Preferably, the subsequent segment generation and validation device 23 determines a circle arc RF having the smallest radius able to be followed by the aircraft flying at a predicted speed; then generates a straight line segment TF associated with this circle arc RF, and carries out a trial for validating the section of trajectory formed by the circle arc RF followed by the straight line segment TF.

With each point recovered in the storage memory 19 (for instance the point P4 on FIG. 3) a speed prediction and a (3D) geometric position are associated. The speed prediction thus allows the subsequent segment generation and validation device 23 to generate a bending radius at the estimated speed, so that the aircraft is able to fly along the segment RF being considered. The subsequent segment generation and validation device 23 creates the circle arc RF the most adapted (that is preferably the smallest flying one) to the predicted speed.

The segment RF is first formed in 2D by the subsequent segment generation and validation device 23. The information relative to the vertical profile allow for the calculation of altitudes on each point of the curve. The subsequent segment generation and validation device 23 then forms the protective shell of the RNP type for the segment RF. 2D and 4D collision trials are carried out on an overprotective discretization of the surface associated with the segment RF being generated.

The following phase of generation of a segment TF is identical to that implemented by the segment generation device 15. The subsequent segment generation and validation device 23 generated a segment TF starting from the ending point of the validated segment RF. The segment TF is built, tested and validated.

Figure 3:
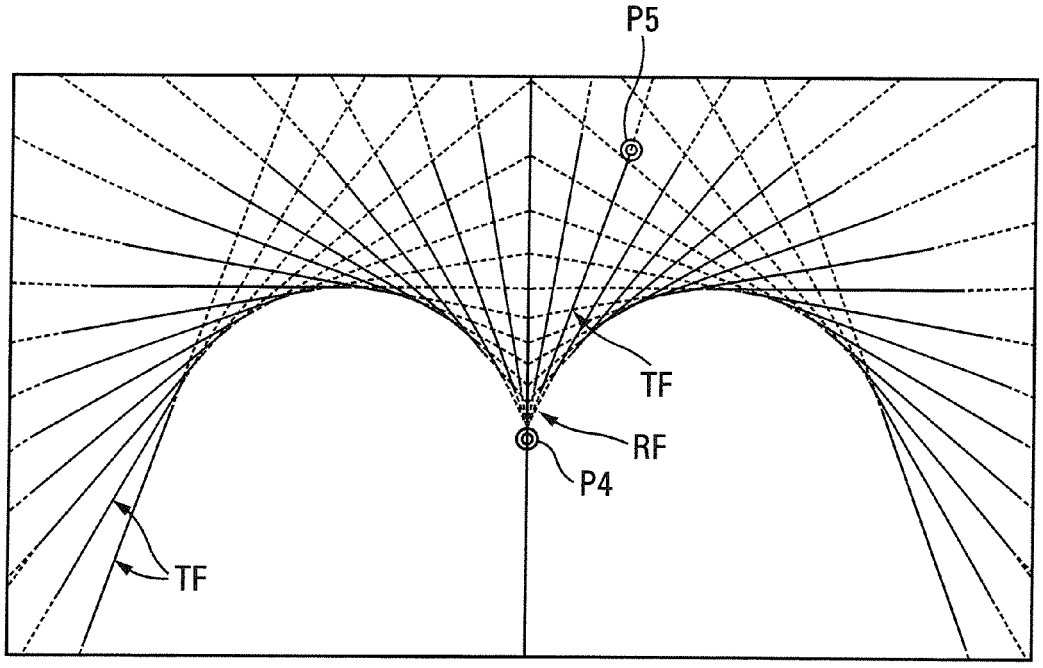

At this stage of the iteration, the virtual trajectories generated by the algorithm and stored in the storage memory 19 have the structure (heading changes from −170° to +170° shown on FIG. 3.

The virtual trajectory score calculator 25 carries out an evaluation of the virtual position associated with the combination RF-TF (point P5 with a +20° heading change for the example of FIG. 3). The new position is scored for the evaluation function and stored in the storage memory 19.

Figure 4:
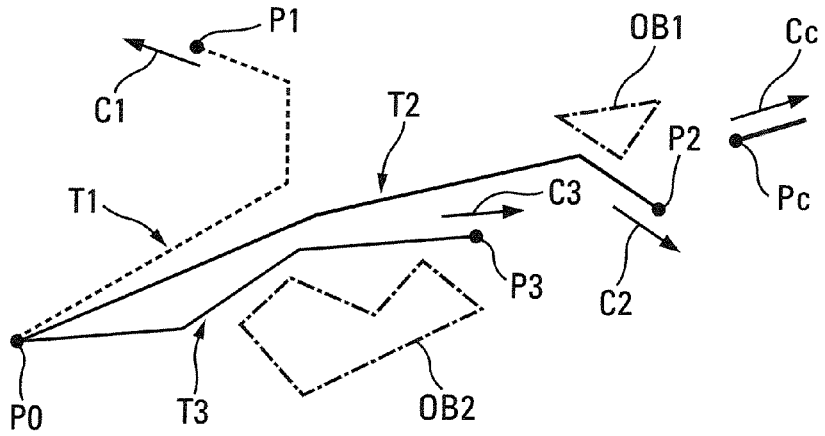

The example of FIG. 4 shows, as an illustration, a situation with three virtual trajectories T1, T2 and T3 (that should avoid the obstacles OB1 and OB2). In such a case:

the virtual trajectory T1 has the worst score, being the result, amongst others, of the downstream end P1 (with a heading C1) being far from the objective (target point Pc) despite the fact that the already followed journey is long;

the virtual trajectory T2 has an intermediary score, as it is closer to the goal (target point Pc) and has followed a nearly direct trajectory. However, as a result of the obstacle OB1, the virtual trajectory score calculator 25 analyzes the bypass possibilities, and T2 has a diverging heading C2 (at the downstream end P2) compared to the target point Pc; and the virtual trajectory T3 has the best score. Although the downstream end P3 is even further spaced apart from the target point Pc, the simultaneous consideration of the distance being followed, the estimation of the remaining distance and of its heading C3 results in that the virtual trajectory score calculator 25 considers that the virtual trajectory T3 is the most interesting one.

The main generation loop is completed after this new position is inserted in the storage memory 19. Upon the following iteration of the loop, the second processor element 9 checks whether the best scored virtual position (amongst those stored) corresponds to the target point Pc entered by the pilot. If this is the case, the second processor element 9 stops the main loop as the virtual trajectory then links the point P0 to the target point Pc.

The second processor element 9 thus repeats the string of previous iterations until the downstream end of the virtual trajectory having the best score at the end of an iteration corresponds to the target point Pc, this virtual trajectory then representing the optimum flight trajectory TV.

Consequently, the device 1 according to the present invention generates, in real time, a 4D flight trajectory TV, having the following characteristics:

it is optimized;

it is free from any collision with surrounding obstacles OB, OB1, OB2, including mobile obstacles;

it respects constraints of energy; and it represents a flight trajectory allowing to link the current position (or current point P0) of the aircraft to a target point Pc defined by an operator, generally the pilot of the aircraft. This target point Pc could, for instance, correspond to the threshold of the selected runway or to a stationary point on a usual STAR or APPR procedure for approach uses or even a meeting point of an initial flight plane.

As set forth above, the thus obtained optimum flight trajectory TV can, amongst others, be displayed on an on-board screen 13 or be transmitted to an air traffic controller. It could also be used as a reference for an autopilot.

The invention claimed is:

1. A method for determining an optimum flight trajectory for an aircraft, in particular a transport airplane, the optimum flight trajectory comprising a lateral trajectory and a vertical trajectory and being defined between a current point and a target point, the method comprising:

(a) using at least one obstacle data base relative to obstacles and a reference vertical profile, as well as a set objective received from an operator at a user input device that indicates a target point, and the method further comprising the following automatic steps:

(b) determining with a first processor element a first section of at least one virtual trajectory from the current point, by carrying out the following successive operations:

(b1) generating with a segment generation device at least one straight line segment, with a predetermined length, starting at the current point, the at least one straight line segment defining the first section of the at least one virtual trajectory, each of the at least one virtual trajectory extending from the current point to a downstream end;

(b2) conducting with a segment validation device a trial for validating each generated straight line segment, wherein the trial uses the at least one obstacle database and the reference vertical profile;

(b3) evaluating with a segment score calculator each validated straight line segment to assign a score being representative of an ability of the straight line segment to meet the set objective, the score being based on both (i) a distance remaining between the downstream end of the corresponding virtual trajectory and the target point, and (ii) a heading difference between a heading at the downstream end and a heading target at the target point; and (b4) recording with a first recording device each straight line segment, with the assigned score, into a storage memory as the first section of the corresponding at least one virtual trajectory;

(c) implementing with a second processor element an iterative processing, comprising the following successive operations, to determine subsequent sections of a chosen virtual trajectory having a best score with respect to the set objective out of all of the at least one virtual trajectory:

(c1) determining with a heading change determination device possible heading changes from the downstream end of the chosen virtual trajectory;

(c2) generating with a subsequent segment generation and validation device for each one of the possible heading changes, a subsequent section of trajectory, starting at the downstream end of the chosen virtual trajectory and comprising at least one of the following elements: a circle arc and a straight line segment, and then conducting a trial for validating the subsequent section of trajectory using the at least one obstacle database and the reference vertical profile, wherein step (c2) further comprises:

generating a circle arc as a function of speed of the aircraft at the downstream end of the chosen virtual trajectory;

generating a straight line segment, associated with the circle arc; and combining the circle arc and the straight line segment to produce the subsequent section of trajectory, which is to be validated by conducting the trial;

(c3) forming with a virtual trajectory updating device for each generated and validated subsequent section of trajectory, at least one updated virtual trajectory made up of the chosen virtual trajectory followed by the subsequent section of trajectory, each of the at least one updated virtual trajectory extending from the current point to a downstream end;

(c4) evaluating with a virtual trajectory score calculator each of the at least one updated virtual trajectory to assign the at least one updated virtual trajectory a score being representative of an ability to reach the set objective, the score being based on both (i) a distance remaining between the downstream end of the at least one updated virtual trajectory and the target point, and (ii) a heading difference between a heading at the downstream end of the at least one updated virtual trajectory and a heading target at the target point;

(c5) recording with a second recording device each of the at least one updated virtual trajectory with the score assigned into the storage memory;

(c6) determining with a virtual trajectory score comparison device, amongst all of the recorded at least one updated virtual trajectory, a new chosen virtual trajectory having a best score with respect to the set objective; and (c7) repeating with the second processor element steps (c1)-(c6) to determine, verify, and evaluate subsequent sections of the new chosen virtual trajectory until the downstream end of the new chosen virtual trajectory determined in step (c6) corresponds to the target point, at which point the second processor element assigns the new chosen virtual trajectory having the best score as the optimum flight trajectory, wherein at each cycle of the iterative processing in steps (c1) through (c6), a single new chosen virtual trajectory is chosen for further processing such that step (c) results in only a single full flight trajectory being generated between the current point and the target point; and (d) transmitting with at least one transmission device the optimum flight trajectory to a viewing screen and/or external devices.

2. The method according to claim 1, wherein generating with the segment generation device at least one straight line segment in step (b1) further comprises:

determining an altitude of the at least one straight line segment using the reference vertical profile.

3. The method according to claim 1, wherein, for carrying out a trial in steps (b2) or (c2) for validating a section of trajectory with either the segment validation device or the subsequent segment generation and validation device, the following steps are automatically performed:

determining a protective shell around the section of trajectory;

comparing the protective shell to obstacles issued from the at least one obstacle database relative to obstacles; and determining that the section of trajectory is considered to be validated if no obstacle is located in said protective shell.

4. The method according to claim 3, wherein comparing the protective shell to obstacles further comprises:

for mobile obstacles, comparing the protective shell to extrapolated positions of the mobile obstacles.

5. The method according to claim 1, wherein evaluating with the virtual trajectory score calculator each of the at least one updated virtual trajectory in step (c4) further comprises:

determining a distance remaining to be covered from the downstream end of the at least one updated virtual trajectory, for reaching the target point;

determining a heading difference between a heading at the downstream end and a heading target at the target point; and calculating the score to be assigned to the at least one updated virtual trajectory as a function of the distance remaining to be covered and of the heading difference.

6. The method according to claim 1, wherein determining with the heading change determination device possible heading changes in step (c1) further comprises:

identifying a plurality of successive headings, according to a predetermined pitch, from a current heading at the downstream end to a maximum heading, and this, on either side of the current heading.

7. The method according to claim 1, wherein generating the circle arc in step (c2) further comprises:

forming the circle arc so as to have a smallest radius able to be followed by the aircraft flying at a predicted speed.

8. The method according to claim 1, wherein the segment generation device or the subsequent segment generation and validation device each determine a straight line segment similarly.

9. A device for determining an optimum flight trajectory for an aircraft, in particular a transport airplane, the flight trajectory comprising a lateral trajectory and a vertical trajectory and being defined between a current point and a target point, wherein the device comprises:

at least one obstacle database relative to obstacles;

a user input device allowing an operator to enter an objective indicating at least the target point;

a first processor element for determining at least one first section of flight trajectory from the current point, the first processor element comprising:

a segment generation device that generates at least one straight line segment with a predetermined length starting at the current point, the at least one straight line segment defining the first section of the at least one virtual trajectory, each of the at least one virtual trajectory extending from the current point to a downstream end;

a segment validation device that conducts a trial for validating each generated straight line segment, wherein the trial uses the at least one obstacle database and a reference vertical profile;

a segment score calculator that evaluates each generated and validated straight line segment, and assigns each straight line segment a score being representative of an ability to reach the set objective, the score being based on both (i) a distance remaining between the downstream end of the corresponding virtual trajectory and the target point, and (ii) a heading difference between a heading at the downstream end and a heading target at the target point; and a first recording device that records, in a storage memory, each straight line segment as the first section of the corresponding at least one virtual trajectory, with the assigned score;

a second processor element that implements an iterative processing to determine subsequent sections of a chosen virtual trajectory having a best score with respect to the set objective out of all of the at least one virtual trajectory, the second processor element comprising:

a heading change determination device that determines possible heading changes from the downstream end of the chosen virtual trajectory;

a subsequent segment generation and validation device that generates, for each one of the possible heading changes, a subsequent section of trajectory starting at the downstream end of the chosen virtual trajectory and comprising at least one of the following elements: a circle arc and a straight line segment, and the subsequent segment generation and validation device then conducts a validation trial on the subsequent section using the at least one obstacle database and the reference vertical profile, wherein the subsequent segment generation and validation device is programmed to perform the following steps automatically:

generate a circle arc as a function of speed of the aircraft at the downstream end of the chosen virtual trajectory;

generate a straight line segment, associated with the circle arc; and combine the circle arc and the straight line segment to produce the subsequent section of trajectory, which is to be validated by conducting the validation trial;

a virtual trajectory updating device that forms, for each generated and validated subsequent section of trajectory, at least one updated virtual trajectory consisting of the chosen virtual trajectory followed with the subsequent section of trajectory, each of the at least one updated virtual trajectory extending from the current point to a downstream end;

a virtual trajectory score calculator that evaluates each of the at least one updated virtual trajectory, and assigns the at least one updated virtual trajectory a score being representative of an ability to reach the set objective, the score being based on both (i) a distance remaining between the downstream end of the updated virtual trajectory and the target point, and (ii) a heading difference between a heading at the downstream end and a heading target at the target point;

a second recording device that records, in the storage memory, each of the at least one updated virtual trajectory with the assigned score; and a virtual trajectory score comparison device that determines, amongst all the virtual trajectories recorded in the storage memory, a new chosen virtual trajectory having a best score with respect to the set objective; wherein the second processor element repeats the iterative processing to determine, verify, and evaluate subsequent sections of the new chosen virtual trajectory until the downstream end of the new chosen virtual trajectory having the best score corresponds to the target point, at which point the second processor element assigns the new chosen virtual trajectory having the best score as the optimum flight trajectory, wherein at each cycle of the iterative processing by the second processor element, a single new chosen virtual trajectory is chosen for further processing such the iterative processing results in only a single full flight trajectory being generated between the current point and the target point; and at least one transmission device that transmits the optimum flight trajectory to a viewing screen user devices and/or external devices.

10. The device according to claim 9, further comprising:

the viewing screen of the aircraft, for displaying the optimum flight trajectory.

11. The device according to claim 9, wherein the at least one transmission device comprises a communication device for transmitting the optimum flight trajectory to devices being external to the device.

12. The device according to claim 9, wherein the at least one obstacle database includes at least one data base relative to stationary obstacles and at least one data base relative to mobile obstacles.

13. An aircraft, characterized in that it comprises a device such as specified in claim 9.

* * * * *